US007188446B2

(12) United States Patent
Snyder et al.

(10) Patent No.: US 7,188,446 B2
(45) Date of Patent: Mar. 13, 2007

(54) FRONT SIGHT WITH ROTARY ELEVATION ADJUSTMENT

(75) Inventors: David Charles Snyder, Palmyra, NY (US); Kenneth A. Call, Henrietta, NY (US)

(73) Assignee: Crosman Corporation, East Bloomfield, NY (US)

( * ) Notice: Subject to any disclaimer, the term of this patent is extended or adjusted under 35 U.S.C. 154(b) by 0 days.

(21) Appl. No.: 11/157,086

(22) Filed: Jun. 20, 2005

(65) Prior Publication Data

US 2007/0006513 A1 Jan. 11, 2007

(51) Int. Cl.
*F41G 1/00* (2006.01)

(52) U.S. Cl. ..... 42/135; 42/136; 42/137; 42/140

(58) Field of Classification Search ..... 42/136, 42/137, 140, 135
See application file for complete search history.

(56) References Cited

U.S. PATENT DOCUMENTS

| | | | | | |
|---|---|---|---|---|---|
| 711,507 | A * | 10/1902 | Junod | ..... | 42/140 |
| 1,027,892 | A * | 5/1912 | Peck et al. | ..... | 42/140 |
| 1,586,413 | A * | 5/1926 | Doornbos | ..... | 42/140 |
| 2,276,446 | A * | 3/1942 | Zimmerman | ..... | 42/140 |
| 2,331,903 | A * | 10/1943 | Garand | ..... | 42/140 |
| 6,615,530 | B2 * | 9/2003 | Johansson | ..... | 42/133 |

* cited by examiner

*Primary Examiner*—Michael J. Carone
*Assistant Examiner*—Gabriel J. Klein
(74) *Attorney, Agent, or Firm*—Brian B. Shaw, Esq.; Stephen B. Salai, Esq.; Harter Secrest & Emery LLP

(57) ABSTRACT

An adjustable front sight includes a carrier with a spiral sighting blade mounted for rotation within a base attached directly or indirectly to a barrel. A progression of sight lands is formed along a peripheral surface of the spiral sighting blade. Rotation of the carrier in opposite directions moves different sight lands into a sighting position at varying heights above the barrel for making elevation adjustments.

20 Claims, 5 Drawing Sheets

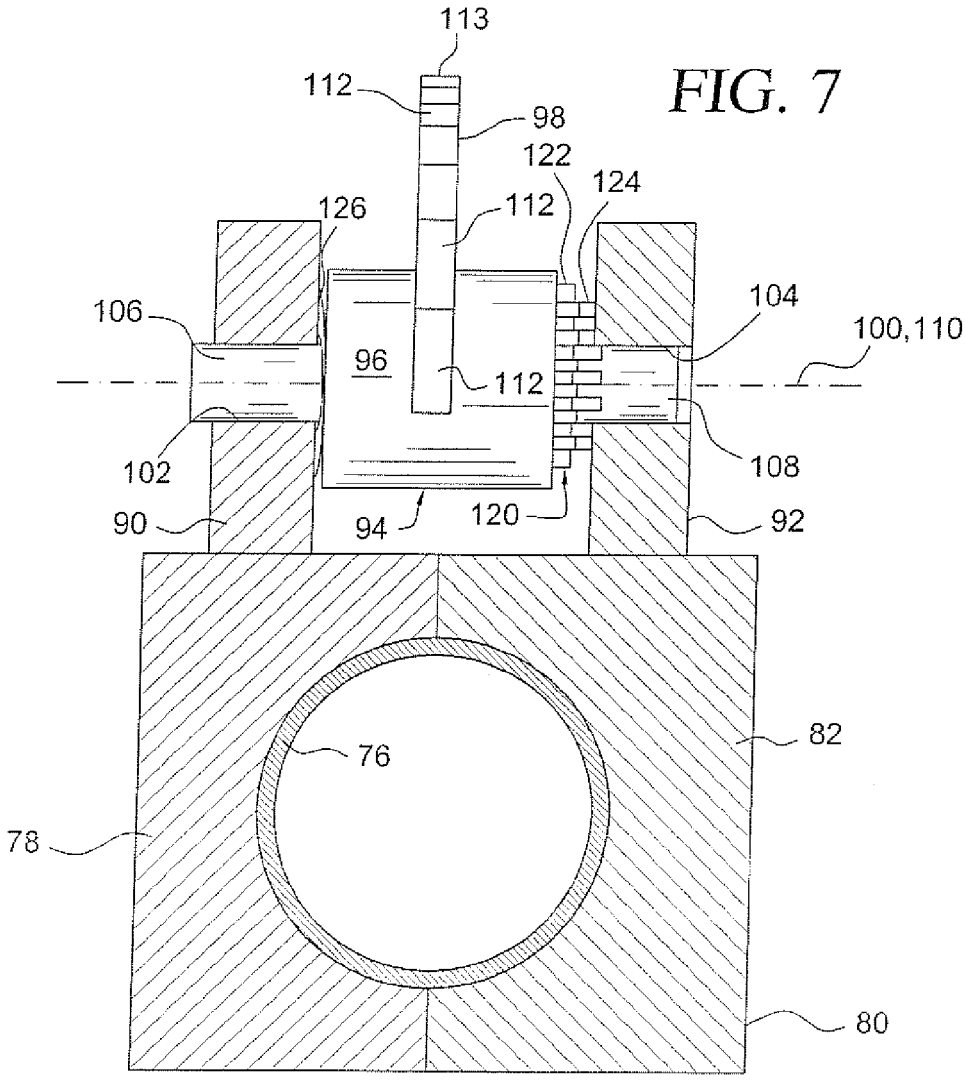
FIG. 7
FIG. 8
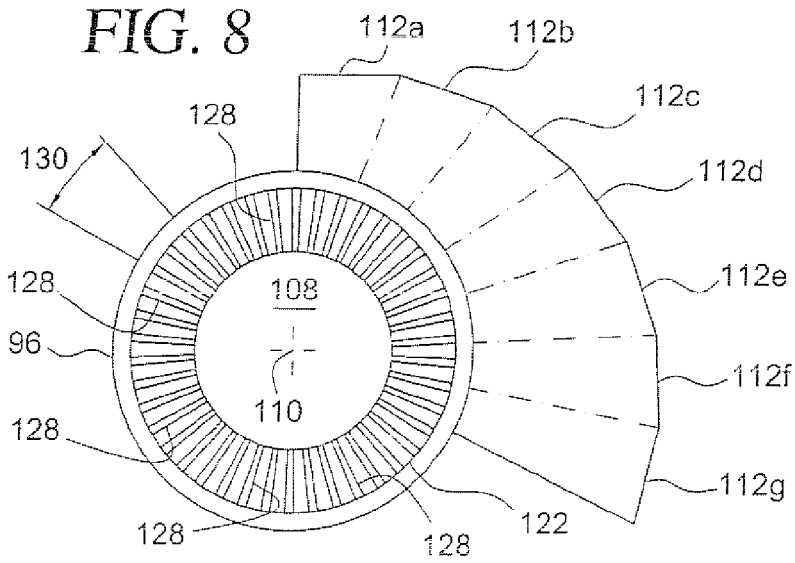

FRONT SIGHT WITH ROTARY ELEVATION ADJUSTMENT

TECHNICAL FIELD

The invention relates to sighting devices for firearms and other muzzle discharging devices requiring aim, and in particular to mechanical front sighting devices situated at the forend of the firearm or muzzle discharging device.

BACKGROUND

Mechanical sighting devices, which are distinguished from optical or image-forming sighting devices, generally include a combination of front and rear sights spaced along a length of a barrel. The front sight is typically located at the forend of the barrel in a position that protrudes above the muzzle of the barrel, and the rear sight is located between the front sight and the eye of a shooter. Aim is taken by aligning a top of the front sight and a target with a centering feature, such as a peep or notch, in the rear sight.

Once installed and properly aligned, the sights are generally fixed. However, adjustments can be made by loosening or partially disassembling components and resetting the components in new positions or by adding or replacing components to make more significant adjustments. Some sights, particularly rear sights, incorporate adjustment mechanisms to make changes in elevation or windage. Sight verniers are sometimes used to scale the adjustments.

SUMMARY OF INVENTION

The invention in one or more of its preferred embodiments provides new sighting-in capabilities by providing a front sight with a rotary elevation adjustment. Preferably, the elevation adjustments are made in predetermined increments so that a shooter can quickly and easily adjust the sight between desired settings. However, continuous elevation adjustments as well as adjustments for windage can also be made.

One example of the invention as an adjustable front sight for a gun barrel includes a base situated atop a forend of a barrel and a sight adjustably mounted on the base for projecting at different heights above the base. An angular adjustment mechanism, which when turned, changes the height of the sight above the base.

Preferably, the sight is supported on the base for angular adjustment around a pivot axis. The sight can take the form of a blade having an axis of rotation and a periphery that varies in radius as a function of angular position around the axis of rotation. Preferably, the blade has a plurality of facets located along the periphery for forming alternative flat tops of the sight.

The preferred blade is angularly indexable around the pivot axis through successive angular positions at which succeeding facets extend in a common direction for forming the alternative flat tops of the sight. A detent mechanism holds the blade at each of the successive angular positions. Trunnions integral with the blade can be used to pivotally mount the blade on the base. At least one of the trunnions preferably includes a feature, such as a slot, configured recess or configured protrusion for effecting the angular adjustment of the blade around the pivot axis. A linear adjustment along the pivot axis can also be accommodated to adjust for windage.

Another example of the invention as a gun barrel having an adjustable front sight includes a front sight situated at a forend of the barrel and an angular adjustment mechanism that is indexable through discrete angular positions for raising and lowering the front sight with respect to the barrel. The front sight is preferably adjustable through incremental variations in height above the barrel associated with the discrete angular positions of the angular adjustment mechanism. A detent mechanism can be used to hold the front sight at one of the incremental variations in height until the front sight is adjusted by use of force to another of the incremental variations in height.

The front sight preferably includes a blade having an axis of rotation and a periphery that varies in radius as a function of angular position around the axis of rotation. The preferred blade has a plurality of facets located along the periphery for forming alternative flat tops of the sight and is angularly indexable through successive angular positions at which succeeding facets extend in a common direction for forming the alternative flat tops of the sight. The detent mechanism can be used to hold the blade at each of the successive angular positions at which succeeding facets form alternative flat tops of the sight.

Another example of the invention as a system for adjusting the front sight of a gun barrel includes a front sighting device having a plurality of sight lands. An adjustment mechanism moves the plurality of sight lands through an operative position for sighting-in the front sight at different elevation settings.

The sight lands are preferably arranged in a progression for incrementally varying the elevation settings, and the adjustment mechanism is preferably adjustable in two directions. The progression of sight lands is preferably arranged for incrementally increasing the elevation settings in one of the two directions and for incrementally decreasing the elevation settings in the other of the two directions.

The preferred sight lands are arranged on a periphery of a sight blade that is pivotally mounted on a sight base, and the preferred adjustment mechanism pivots the sight blade in the two directions for increasing and decreasing the elevation settings. A catch can be used to bias the sight blade into discrete angular positions at which individual sight lands are operatively positioned for sighting. The catch is releasable for indexing the sight blade between the discrete angular positions.

For example, a shooter can make incremental elevation adjustments by rotating the sight blade through one or more of the discrete angular positions. At each such position, the catch at least partially engages an indexing feature of the blade so that the amount of adjustment can be readily associated with the number of such engagements. Accordingly, by recalling the number of engagements between the settings, the sight blade can be readily shifted between desired settings.

The adjustable front sight can be mounted directly on a barrel or on a frame that supports the barrel. The sight alignment adjustments contemplated by the invention are particularly important in the latter instance because of the additional alignment tolerances between the barrel and the frame.

BRIEF DESCRIPTION OF THE DRAWING FIGURES

FIG. 7 is a partial cross-sectional view of the adjustable sighting device and frame along the line of sight with a detent indexing mechanism disengaged.

FIG. 8 is a schematic side view of the rotary blade carrier showing in addition to a succession of facets a coupling member of the indexing mechanism.

DETAILED DESCRIPTION

Figure 1:
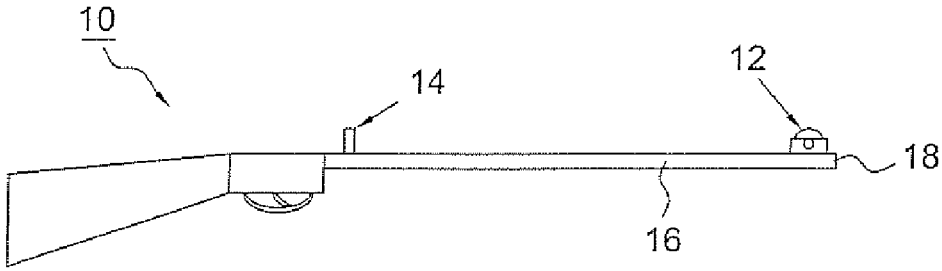
FIG. 1 is a schematic side view of a rifle adapted to incorporate an adjustable front sight mounted on a barrel in accordance with the invention.

A rifle 10 is depicted in FIG. 1 as an example of a firearm or other muzzle discharging device requiring aim to which the invention can be applied. These include such devices as pistols, shotguns, rifles, air guns, soft air guns, paintball markers, and signal cannons. The illustrated sighting system is a mechanical sighting system including both a front sight 12 and a rear sight 14. The front sight 12 is located at the forend of a barrel 16 just above a muzzle 18. The rear sight 14 is located near the other end of the barrel 16 between the intended location of a shooter's eye (not shown) and the front sight 12.

Figure 2:
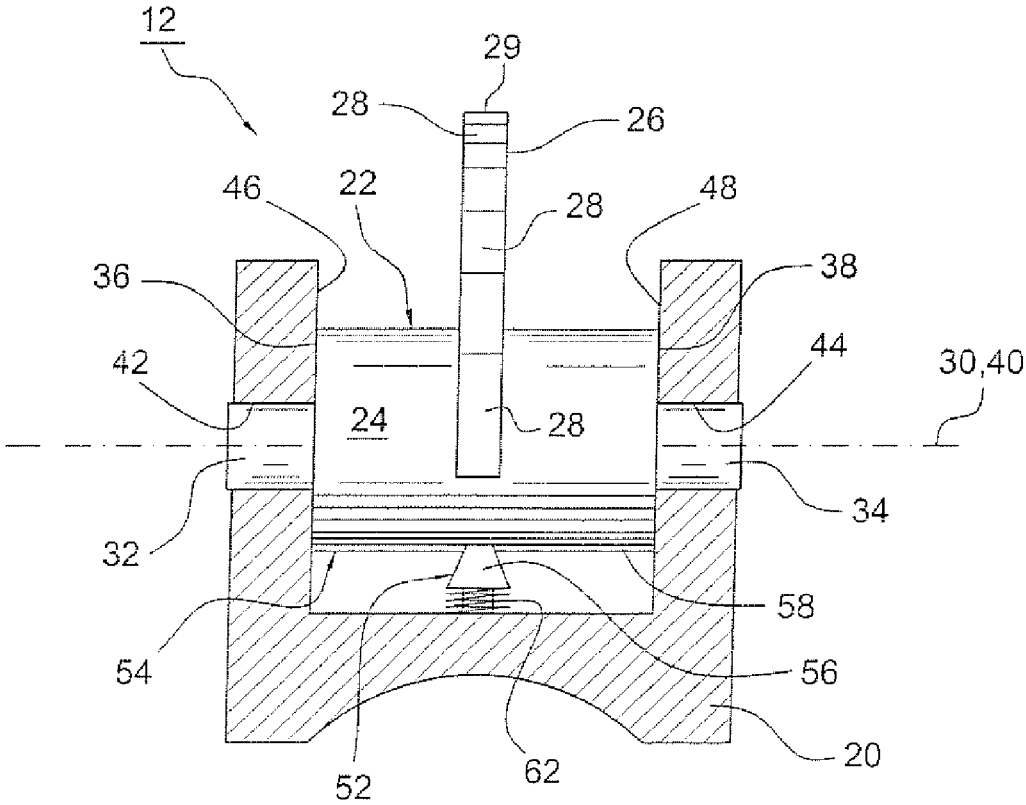
FIG. 2 is a partial cross-sectional view of the adjustable sighting device along the line of sight.
Figure 3:
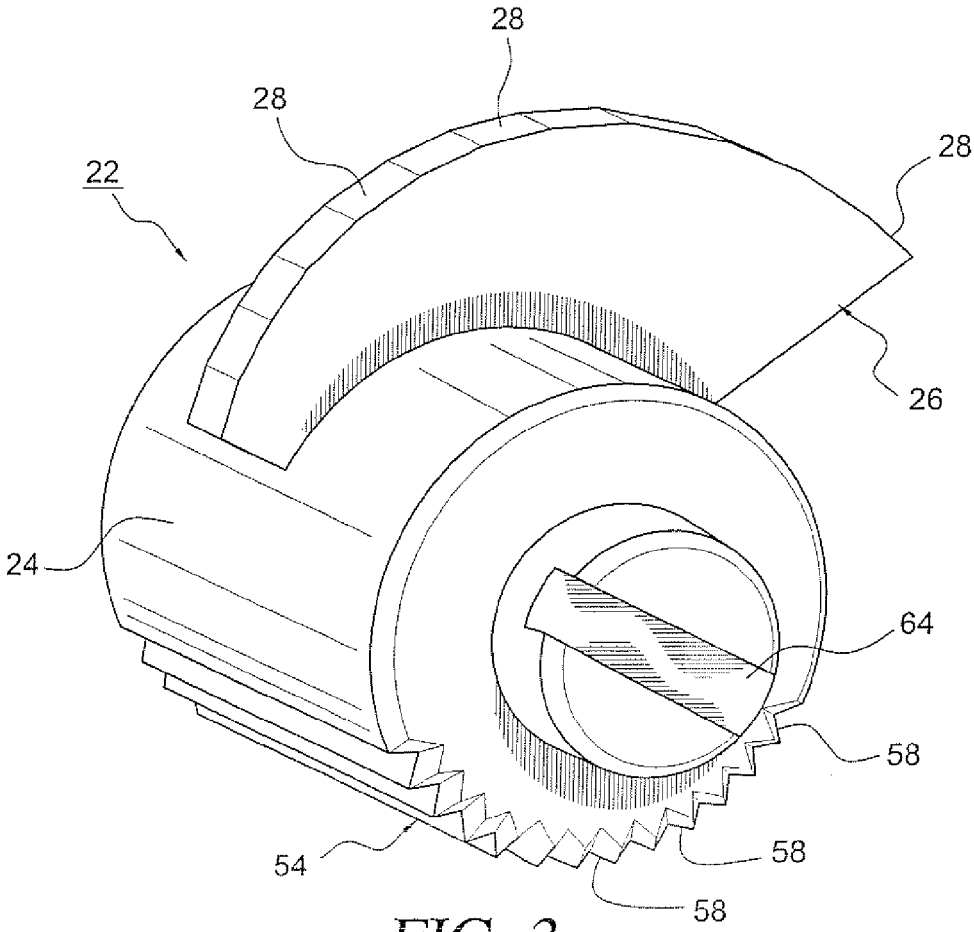
FIG. 3 is a perspective view of a rotary blade carrier having a succession of facets formed along a peripheral surface as alternative sight lands that can be rotated into a sighting position.

The front sight 12 is formed as an assembly as shown in FIG. 2 including a base 20 mounted atop the barrel 16 and a rotary blade carrier 22 supported for angular motion on the base 20. The base 20 can be fixed directly to the barrel 16 in a variety of ways including, barrel band, dovetail, and linear clamping type mounts or indirectly to the barrel 16 within a frame or other support for the barrel. The rotary blade carrier 22, which is best seen in FIG. 3, includes a cylindrical main body 24 and a spiral sighting blade 26 projecting above the main body 24. A succession of facets 28 is formed along a periphery of the spiral sighting blade 26. Trunnions 32 and 34 project from opposite ends 36 and 38 of the cylindrical main body 24 defining a rotational axis 30 of the rotary blade carrier 22.

The trunnions 32 and 34 are received within bearings 42 and 44 formed in the base 20, which are aligned with each other to define a pivot axis 40 coinciding with the rotational axis 30 of the rotary blade carrier 22. The bearings 42 and 44 are formed in sidewalls 46 and 48 of the base 20, which also serve as bearing surfaces for the opposite ends 36 and 38 of the cylindrical main body 24. Rotation of the rotary blade carrier 22 rotates successive facets 28 into a sighting position as the flat top of a sight land 29 extending substantially parallel to firing axis of the barrel 16 in alignment with the rear sight 14.

Figure 4:
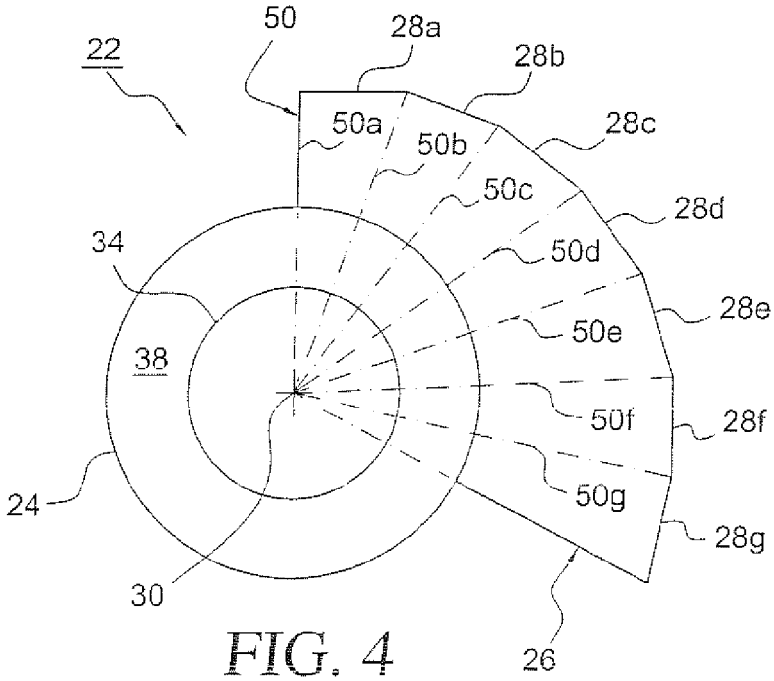
FIG. 4 is a schematic side view of the rotary blade carrier showing the succession of facets at progressively varying radial distances from an axis of rotation.

As seen more schematically in FIG. 4, the facets 28 (referenced as facets 28*a* through 28*g*) are each oriented substantially perpendicular to a lead radius 50 (referenced as 50*a* through 50*g*) passing through the rotational axis 30 of the rotary blade carrier 22 as well as through the pivot axis 40 of the base. Each successive facet 28 is angularly spaced apart around the rotational axis 30, such as at increments of approximately 10 degrees, and is linearly spaced apart along the rotational axis 30 through increments, such as 0.01 inches. Rotation of the rotary blade carrier 22 in one direction presents the succession of facets 28 as alternative sight lands 29 incrementally increasing in height above the barrel 16, and rotation of the rotary blade carrier 22 in the opposite direction presents the succession of facets 28 as alternative sight lands 29 incrementally decreasing in height above the barrel 16.

Returning to FIG. 2, a detent mechanism 52, which holds the individual facets 28 in the sighting position, includes a portion of the cylindrical main body 24 formed as ratchet 54 and a relatively biased catch 56 engageable with notches 58 within the ratchet 54. Each of the notches 58, as best seen in FIG. 3, is angularly registered with one of the facets 28 so that when an individual notch 58 is engaged by the catch 56, a corresponding facet 28 is secured in the sighting position. A spring mechanism 62, such as a compression spring, biases the catch 56 into engagement with the notches 58, but allows the catch 56 to be displaced out of engagement with one of the notches 58 and into engagement with another of the notches 58 in response to a torque applied to the cylindrical main body 24. Alternatively, the catch 56 an be formed of a resilient material and configured to be biased into engagement with the notches 58, wherein a deformation or flexing of the catch allows the catch to be displaced out of engagement with one of the notches. In one configuration, a slot 64 formed in the trunnion 32 allows for the transfer of torque to the cylindrical main body 24 through a screwdriver or other torque-imparting tool. Other configurations, such as, but not limited to, Phillips head, bolt head, star or Allen head can be used to allow for the transfer of torque to the cylindrical main body 24 through a torque-imparting tool. Auditory and tensile feedback from the successive engagements of the detent mechanism 52 allows an adjuster to count the number of facets 28 through which an adjustment is made and this information can be recalled for referencing prior adjustments.

Figure 5:
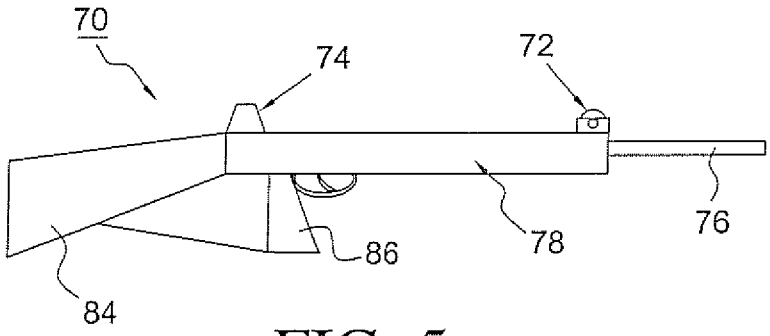
FIG. 5 is a schematic side view of an air-powered carbine adapted to incorporate an adjustable front sight mounted on a frame in accordance with the invention.

FIG. 5 depicts another example of a muzzle-discharging device in the form of an air-powered carbine 70 also fashioned with front and rear sights 72 and 74 for targeting soft or hard discharges (e.g., pellets) from a barrel 76. However, instead of mounting the front sight 72 directly on the barrel 76, the front sight 72 is mounted on a vertical extension of a frame 78 within which the barrel 76 is supported.

Figure 6:
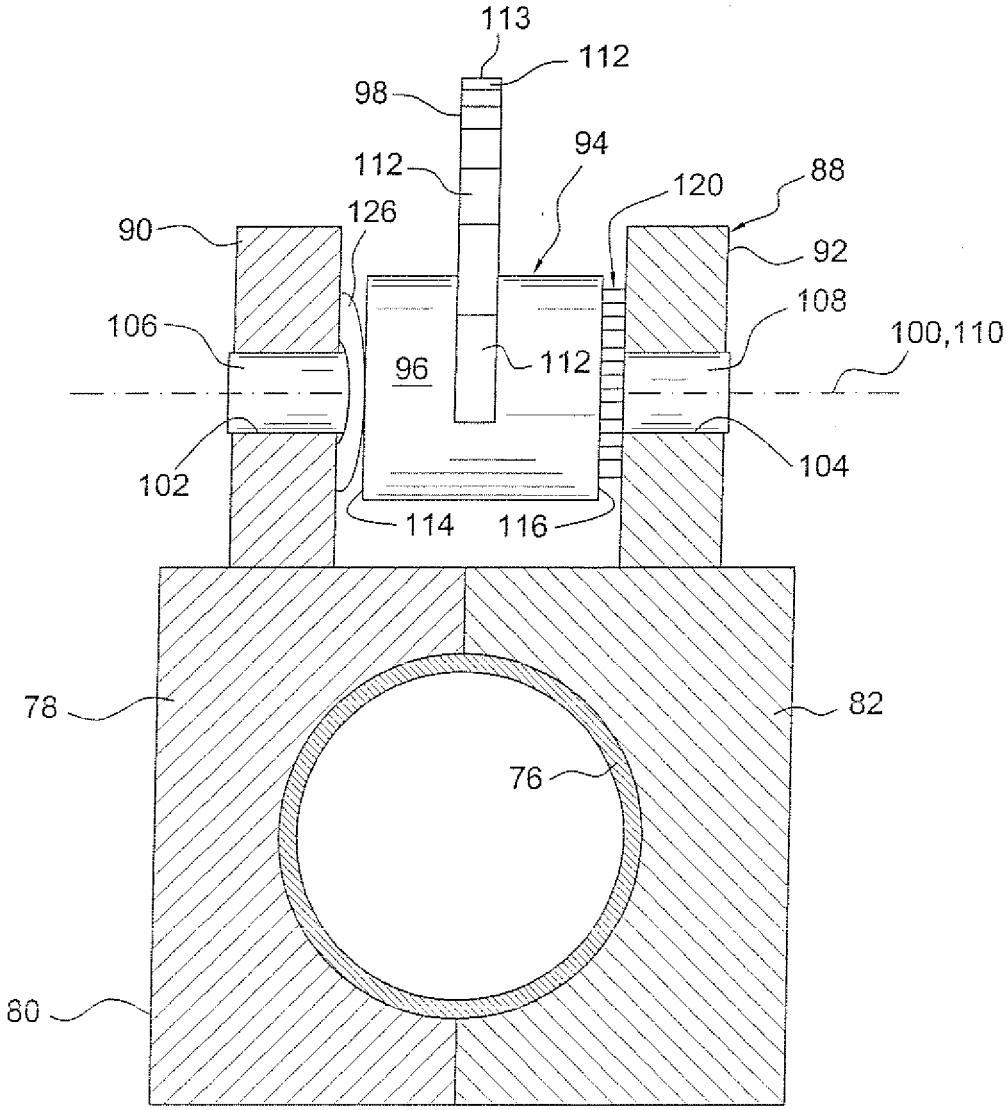
FIG. 6 is a partial cross-sectional view of the adjustable sighting device and frame along the line of sight with a detent indexing mechanism engaged.

The frame 78 is spit into two halves 80 and 82 as seen in FIGS. 6 and 7 for purposes of assembly and extends from the front sight 72 through a stock 84, including a pistol-grip section 86. Other frames appropriate for mounting the front sight 72 can extend different lengths such as for allowing the separate assembly of other features such as the stock 84 and the pistol-grip section 86. The frame halves 80 and 82 include vertical extensions 90 and 92, which together form a base 88 for pivotally supporting a rotary blade carrier 94 of the front sight 72. The rotary blade carrier 94 includes a cylindrical main body 96 and a spiral sighting blade 98. Bearing surfaces 102 and 104 within the vertical extensions 90 and 92 define a pivot axis 100 and are sized for receiving trunnions 106 and 108 that project from end walls 114 and 116 of the cylindrical main body 96. The trunnions 106 and 108 define a rotational axis 110 for the rotary blade carrier 94 coinciding with the pivot axis 100.

The spiral sighting blade 98 includes along its peripheral surface a succession of facets 112 that progressively vary in distance from the rotational axis 110. Rotation of the rotary blade carrier 94 about the pivot axis 100 moves the facets 112 through a sighting position for functioning as alternative sight lands 113 oriented substantially parallel to the barrel 76 and in alignment with the rear sight 74. The progressive variation in the distance of succeeding facets 112 from the rotational axis 110 provides for incrementally varying the height at which the succeeding facets 112 project above the barrel 76 in the sighting position. Rotation of the rotary blade carrier 94 in one direction presents the succession of facets 112 as alternative sight lands 113 that incrementally increase in height above the barrel 76, and rotation of the rotary blade carrier 94 in an opposite direction presents the succession of facets 112 as alternative sight lands 113 that incrementally decrease in height above the barrel 76. Incremental variations of 0.01 inches are contemplated for one design, but smaller incremental variations can be made for making finer elevation adjustments and larger incremental variations can be made for expanding the overall range of elevation adjustments.

A detent mechanism 120 is formed as an axial coupling with one coupling member 122 rotatably fixed to the end wall 104 of the cylindrical body 96 and another coupling member 124 rotatably fixed to the vertical extension 92. As shown in FIG. 6, a spring 126 biases the two coupling members 122 and 124 into engagement for preventing rotation of the rotary blade carrier 94 and thereby holding one of the facets 112 in the sighting position as the sight land 113. However, as shown in FIG. 7, the spring 126 can be axially displaced together with the rotary blade carrier 94 for disengaging the two coupling members 122 and 124 and thereby allowing alternative facets 112 to be rotated through the sighting position. Alternatively, the spring 126 can be replaced by formation of the body 96 to include 4 projecting tangs which are sufficiently resilient to bias the body. Preferably, the coupling members 122 and 124 are formed with mating teeth 128 having pressure angles that cause a threshold torque applied to one of the trunnions 106 or 108 to be converted in part into an axial separating force between the coupling members 122 and 124 for relatively indexing (rotating) the coupling members through successive tooth engagements.

An angular pitch spacing 130 between the teeth 128 preferably corresponds to an angular spacing between the facets 112 so that at each successive indexing position of the coupling 120 at which the mating teeth 128 are locked into engagement, a successive facet 112 is held in the sighting position as the sight land 113. Both auditory and tensile feedback can be provided to an adjuster for counting the number of facets 112 through which the rotary blade carrier has been indexed.

Figure 9:
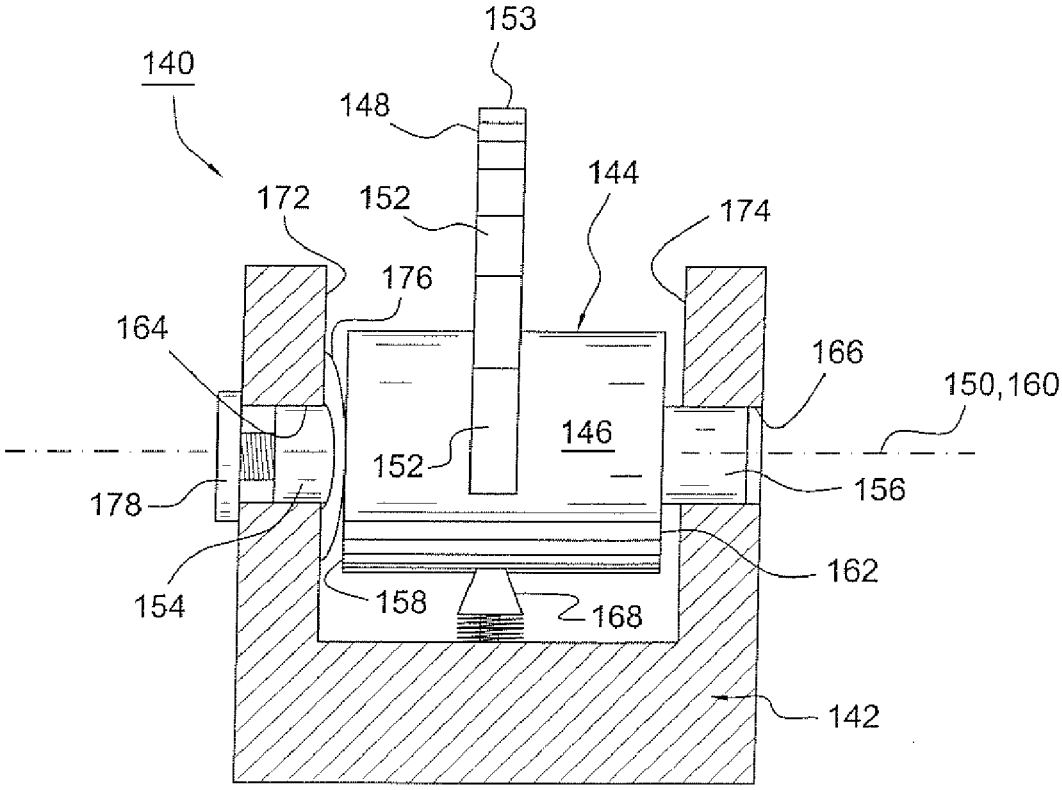
FIG. 9 is a partial cross-sectional view of an alternative adjustable sighting device arranged for making adjustments to windage as well as elevation.

The adjustable front sight can include adjustments for windage as well as elevation as shown in FIG. 9. The illustrated front sight 140 includes a base 142, which is mountable directly or indirectly on a barrel, and a rotary blade carrier 144, which is pivotally mounted on the base 142. The rotary blade carrier 144 includes a cylindrical main body 146 and a spiral sighting blade 148 that projects above the cylindrical main body 146. A succession of facets 152 is formed along a periphery of the spiral sighting blade 148. Trunnions 154 and 156 project from opposite ends 158 and 162 of the cylindrical main body 24 defining a rotational axis 150 of the rotary blade carrier 144.

Within the base 142, bearings 164 and 166 define a pivot axis 160 and are sized for receiving the trunnions 154 and 156 in a position for pivoting the rotary blade carrier 144 about its rotational axis 150. A detent mechanism 168 allows for incremental rotations of the rotary blade carrier 144 for moving the succession of facets 152 through a sighting position as alternative sight lands 153 similar to the embodiment of FIGS. 1–4.

However, in addition to the elevation adjustment similar to that of FIGS. 1–4, the adjustable front sight 140 of FIG. 9 includes a windage adjustment by providing for the axial displacement of the rotary blade carrier 144 along the pivot axis 160. The opposite ends 158 and 162 of the cylindrical main body 146 are spaced apart from side walls 172 and 174 of the base 142 to provide room for the axial displacement. A spring 176 biases the rotary blade carrier 144 in one direction along the pivot axis 150. However, a screw adjuster 178 limits the amount that the rotary blade carrier is displaced along the pivot axis 150. Rotation of the screw adjuster 178 in one angular direction moves the rotary blade carrier 144 together with the sighting blade 148 in one linear direction along the pivot axis 150, and rotation of the screw adjuster 178 in the opposite angular direction moves the rotary blade carrier 144 together with the sighting blade 148 in the opposite linear direction along the pivot axis 150. The opposite liner directions of sighting blade motion along the pivot axis 150 provide windage adjustments for the front sight 140. A variety of other linear adjustment mechanisms could also be used to append a windage adjustment to the front sights made in accordance with the invention.

Figure 10:
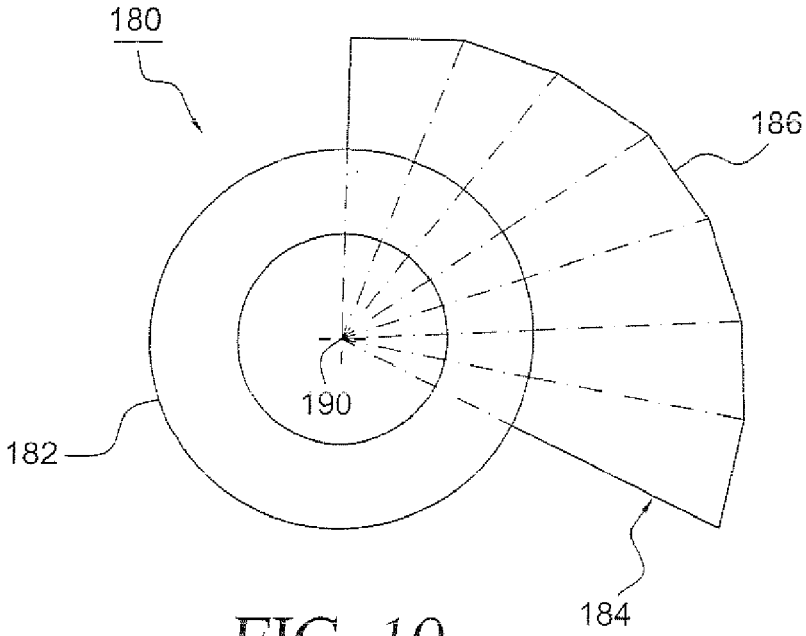
FIG. 10 is a schematic side view of an alternative rotary blade carrier having an uninterrupted spiral periphery for making elevation adjustments either incrementally or over a continuum.

An alternative rotary blade carrier 180 is depicted in FIG. 10 having a cylindrical main body 182 arranged for rotation about an axis 190 and a spiral sighting blade 184 having an uninterrupted periphery 186 in the form of a spiral or substantially continuous curvilinear profile for making elevation adjustments either incrementally or over a continuum. The spiral sighting blade 184 can be mounted on a base similar to the bases of the preceding examples and can be held in predetermined incremental positions by a detent mechanism similar to the detent mechanisms of the preceding examples. Alternatively, a friction mechanism or other securing mechanism can be used to hold the spiral sighting blade 184 in any of a continuum of positions for making even finer adjustments to elevation.

Although described with respect to a limited number of examples, those of skill in the art will appreciate that various modifications and additions can be made in accordance with the overall teaching of the invention. Certainly, the number of facets and the height adjustment between facets can be selected to provide the desired increment and range of elevation adjustment. The facets can be stepped with respect to each other or replaced by a continuous curve. In place of facets, individual beads could be supported at progressively varying radii of a rotary carrier. Alternative mechanisms can be used for indexing the rotary carrier on an intermittent or continuous basis and the base for the rotary carrier can be mounted in various ways directly or indirectly on a barrel. Other adjustments can also be incorporated into the front sight including adjustments for windage as well as elevation.

What is claimed is:

1. A system for adjusting the front sight of a muzzle discharging barrel having a longitudinal dimension along which a projectile travels, the system comprising:

a front sighting device having a plurality of sight lands arranged in a progression for incrementally varying the elevation settings, the sight lands are arranged on a periphery of a sight blade that is pivotally mounted on a sight base;

an adjustment mechanism for moving the plurality of sight lands about an axis transverse to the longitudinal dimension through an operative position for sighting-in the front sight at different elevation settings, the adjustment mechanism adjustable in two directions and the progression of sight lands arranged for incrementally increasing the elevation settings in one of the two directions and for incrementally decreasing the elevation settings in the other of the two directions; and a catch biasing the sight blade into discrete angular positions at which individual sight lands are operatively positioned for sighting, the sight blade supported on a rotatable body having indexing features associated with each of the sight lands, the catch is relatively biased into engagement with individual indexing features for holding the sight blade at the discrete angular positions, and the adjustment mechanism pivots the sight blade in the two directions for increasing and decreasing the elevation settings.

2. The system of claim 1 in which the catch is releasable for indexing the sight blade between the discrete angular positions.

3. A system for adjusting the front sight of a muzzle discharging barrel having a longitudinal axis, the system comprising:

a front sighting device having a plurality of incremental successive sight lands rotatable about an axis transverse to the longitudinal axis, the sight lands arranged in a progression for incrementally varying the elevation settings, the sight lands arranged on a periphery of a sight blade pivotally mounted on a sight base and the sight blade is supported on a rotatable body having indexing features associated with each of the sight lands; and an adjustment mechanism for moving the plurality of sight lands through an operative position for sighting-in the front sight at different elevation settings, the adjustment mechanism adjustable in two directions and the progression of sight lands arranged for incrementally increasing the elevation settings in one of the two directions and for incrementally decreasing the elevation settings in the other of the two directions; and a catch biasing the sight blade into discrete angular positions at which individual sight lands are operatively positioned for sighting, wherein the catch is relatively biased into engagement with individual indexing features for holding the sight blade at the discrete angular positions, and the adjustment mechanism pivots the sight blade in the two directions for increasing and decreasing the elevation settings.

4. The system of claim 3, wherein the plurality of sight lands are continuous.

5. The system of claim 3, further comprising a frame supporting the barrel and the sight base is supported on the frame.

6. The system of claim 3, wherein the rotatable body includes integral trunnions.

7. The system of claim 6, wherein one of the trunnions includes a feature for effecting the angular adjustment of the sight blade.

8. The system of claim 3, wherein the sight blade is supported for linear adjustment along the pivot axis to adjust for windage.

9. The system of claim 3, wherein the sight blade has a periphery that substantially continually varies in radius as a function of angular position around the axis.

10. The system of claim 3, wherein the sight base is formed on a frame that supports the barrel, the frame formed from two halves along a length of the barrel.

11. The system of claim 10, wherein the sight blade is rotatably supported between extensions of the two frame halves.

12. The system of claim 1, wherein the plurality of sight lands are continuous.

13. The system of claim 1, further comprising a frame supporting the barrel and the sight base is supported on the frame.

14. The system of claim 1, wherein the rotatable body includes integral trunnions.

15. The system of claim 14, wherein one of the trunnions includes a feature for effecting the angular adjustment of the sight blade.

16. The system of claim 1, wherein the sight blade is supported for linear adjustment along the axis to adjust for windage.

17. The system of claim 1, wherein the sight blade has a periphery that substantially continually varies in radius as a function of angular position around the axis.

18. The system of claim 1, wherein the sight base is formed on a frame that supports the barrel.

19. The system of claim 18, wherein the frame is formed of two halves along a length of the barrel.

20. The system of claim 18, wherein the sight blade is rotatably supported between extensions of the two frame halves.

* * * * *